US006415681B1

(12) United States Patent
Porter et al.

(10) Patent No.: US 6,415,681 B1
(45) Date of Patent: Jul. 9, 2002

(54) PEDAL ASSEMBLY

(75) Inventors: Curtis H. Porter, Huntsville; Michael H. Schmidt, Moberly; Wayne Soucie, Columbia; Jeffrey Tayon, Moberly, all of MO (US)

(73) Assignee: Orscheln Products LLC, Moberly, MO (US)

( * ) Notice: Subject to any disclaimer, the term of this patent is extended or adjusted under 35 U.S.C. 154(b) by 0 days.

(21) Appl. No.: 09/715,645

(22) Filed: Nov. 17, 2000

Related U.S. Application Data

(60) Provisional application No. 60/226,824, filed on Aug. 22, 2000, and provisional application No. 60/166,062, filed on Nov. 17, 1999.

(51) Int. Cl.[7] ..... G05G 1/14

(52) U.S. Cl. ..... 74/512; 74/535; 74/529; 192/13 R

(58) Field of Search ..... 74/512, 513, 514, 74/473.17, 478, 478.5, 529, 506, 561, 531; 192/219.7; 477/194

(56) References Cited

U.S. PATENT DOCUMENTS

| | | | | |
|---|---|---|---|---|
| 3,722,314 A | * | 3/1973 | Sorenson et al. | 180/336 |
| 3,961,691 A | | 6/1976 | Eng | |
| 4,127,241 A | | 11/1978 | Conti | |
| 4,441,596 A | * | 4/1984 | Nakahara et al. | 192/12 C |
| 4,627,522 A | | 12/1986 | Ulrich et al. | |
| 4,872,368 A | | 10/1989 | Porter | |
| 4,876,914 A | | 10/1989 | Kanno | |
| 4,881,425 A | | 11/1989 | Kanno | |
| 4,895,227 A | | 1/1990 | Grenier et al. | |
| 5,009,292 A | | 4/1991 | Hoffman, Jr. et al. | |
| 5,042,317 A | | 8/1991 | Malara | |
| 5,217,094 A | | 6/1993 | Walter et al. | |
| 5,309,786 A | | 5/1994 | Pare et al. | |
| 5,327,797 A | | 7/1994 | Seifrit, Jr. | |
| 5,533,420 A | * | 7/1996 | Perisho | 74/501.5 R |
| 5,546,828 A | * | 8/1996 | Golarz | 74/512 |
| 5,588,335 A | * | 12/1996 | Strait | 74/512 |
| 5,628,387 A | | 5/1997 | Schantzen | |
| 5,730,256 A | | 3/1998 | Namngani | |
| 5,775,174 A | | 7/1998 | Kanbe et al. | |
| 5,791,263 A | | 8/1998 | Watt et al. | |
| 5,875,688 A | | 3/1999 | Porter et al. | |
| 5,907,977 A | | 6/1999 | Huebner et al. | |
| 5,924,522 A | | 7/1999 | Ostrobrod | |
| 5,937,973 A | | 8/1999 | Liebetran | |
| 6,286,389 B1 | * | 9/2001 | Papadatos | 74/535 |

FOREIGN PATENT DOCUMENTS

| | | |
|---|---|---|
| EP | 0 331 159 B1 | 3/1989 |
| EP | 0 331 159 A1 | 3/1989 |
| EP | 0 351 131 A3 | 7/1989 |
| EP | 0 351 131 A2 | 7/1989 |
| EP | 0 351 131 B1 | 7/1989 |
| EP | 0 527 518 B1 | 7/1992 |
| EP | 0 527 518 A1 | 7/1992 |
| WO | WO 92/21542 | 5/1992 |
| WO | WO 93/09360 | 10/1992 |

* cited by examiner

*Primary Examiner*—Rodney H. Bonck
*Assistant Examiner*—David D Le
(74) *Attorney, Agent, or Firm*—Michael K. Boyer

(57) ABSTRACT

The disclosure relates to an assembly comprising parking brake and service brake pedal levers. The parking brake pedal lever engages and is maintained in a fixed location by a torsion spring. The torsion spring can be released by operating either the service brake or an accelerator.

21 Claims, 5 Drawing Sheets

PEDAL ASSEMBLY

The subject matter disclosed herein claims benefit of prior filed U.S. patent application Ser. No. 60/226,824, filed on Aug. 22, 2000 and application Ser. No. 60/166,062, filed on Nov. 17, 1999 in the names of Porter et al., and entitled "Pedal Assembly"; the disclosures of which are hereby incorporated by reference.

FIELD OF THE INVENTION

The instant invention relates to an improved pedal assembly comprising a service brake, parking brake and in some cases an accelerator. The assembly can be employed for operating a wide range of vehicles such as all terrain vehicles, lawn equipment and tractors, utility cars, and is especially desirable for use in golf car operation.

BACKGROUND OF THE INVENTION

Conventional pedal assemblies are used as an interface between an operator and a vehicle so that the vehicle can be operated by pedal controls. These controls are typically in the form of a pedal assembly comprising a service brake, parking brake and in some cases an accelerator. Power can be supplied to the vehicle by an electric motor or internal combustion engine.

Conventional pedal assemblies contain a large number of components and are time consuming to assemble. Conventional pedal assemblies, for example, golf cars are relatively complex and include multiple pivot points, linkages, springs, pawls, ratchets, among other components. Conventional pedal assemblies may permit unintended operation of the parking brake when operating the service brake.

Conventional golf car assemblies are typically floor mounted and extend underneath the car. As a result, conventional assemblies are exposed to a corrosion environment caused by fertilizers and herbicides that are applied to golf courses.

SUMMARY OF THE INVENTION

The instant invention solves problems associated with conventional pedal assemblies by providing a pedal assembly having a reduced number of components, greater flexibility in mounting the assembly within the vehicle, improved mode of operation, among other desirable aspects. The inventive pedal assembly comprises a combined service and parking brake system that can be employed alone, or with an accelerator in a pedal assembly, e.g., a modular pedal assembly including related cables.

While the instant invention includes many aspects, in one aspect of the invention the service and parking brake are applied by using the same pedal level. The service brake modulates or is used by depressing the brake pedal a defined portion of its entire lever path. The first portion of the pedal path operates the brake as a service brake. When depressed beyond or past the first portion, the brake becomes locked into position and functions as a parking brake. The brake is released by depressing the accelerator.

In another aspect of the invention, the parking and service brake pedal share a common lever. The end of the pedal lever defines a surface (e.g., a pedal pad) wherein a portion of that surface includes a pedal button. To operate as a service brake, the operator depresses the pedal button while pushing the pedal. This will disengage a torsion lock spring (mounted around a drum or hub upon which the pedal lever rotates as is described below in greater detail), and allow the pedal lever to rotate in either direction thereby permitting the vehicle operator to modulate operation of the service brake. To operate as a park brake, the operator depresses the pedal pad surface outside of the button area. The button will pop-up or protrude upwardly beyond the surface of the pedal thereby providing a visual indication that the brake is operating as a parking brake. When the pedal is pushed without depressing the pedal button (i.e., by depressing the pedal pad outside of the button area), a "free leg" of the torsion spring will tighten against the drum or hub (when the pedal tries to return) thereby causing the pedal to hold in its applied position.

In a further aspect of the invention, the parking and service brake are mounted on separate levers such that the service brake lever can be applied separately from the parking brake lever. When both levers are depressed the assembly functions as a service brake and when the parking brake lever is applied separately the assembly functions as a parking brake. The parking brake can be released by depressing the service brake pedal, or the accelerator pedal. The dual pedal service/parking brake system can be adapted for mounting either under a dash or upon a vehicular floor. Since this aspect employs dual brake levers, the pedal pads can possess a wide range of configurations.

BRIEF DESCRIPTION OF THE DRAWINGS

FIG. 1 illustrates the pedal assembly in an assembled format.

FIG. 2 illustrates the pedal assembly in an exploded format.

FIGS. 3 and 4 illustrate a parking brake hub that is employed in one aspect of the invention.

FIG. 5 illustrates a service brake hub that is employed in one aspect of the invention.

FIG. 6 illustrates a release lever that is employed in one aspect of the invention.

FIG. 7 illustrates another aspect of the invention illustrated in FIGS. 1–6 that is mounted under-dash or in a suspended design.

FIG. 8 illustrates a second aspect of the invention in an assembled format.

FIG. 9 illustrates the aspect in FIG. 8 in an exploded format.

FIG. 10 illustrates the torsion spring and release rod employed in this aspect of the invention.

FIG. 11 illustrates the release rod interconnection to the remote button.

DETAILED DESCRIPTION

Figure 1:
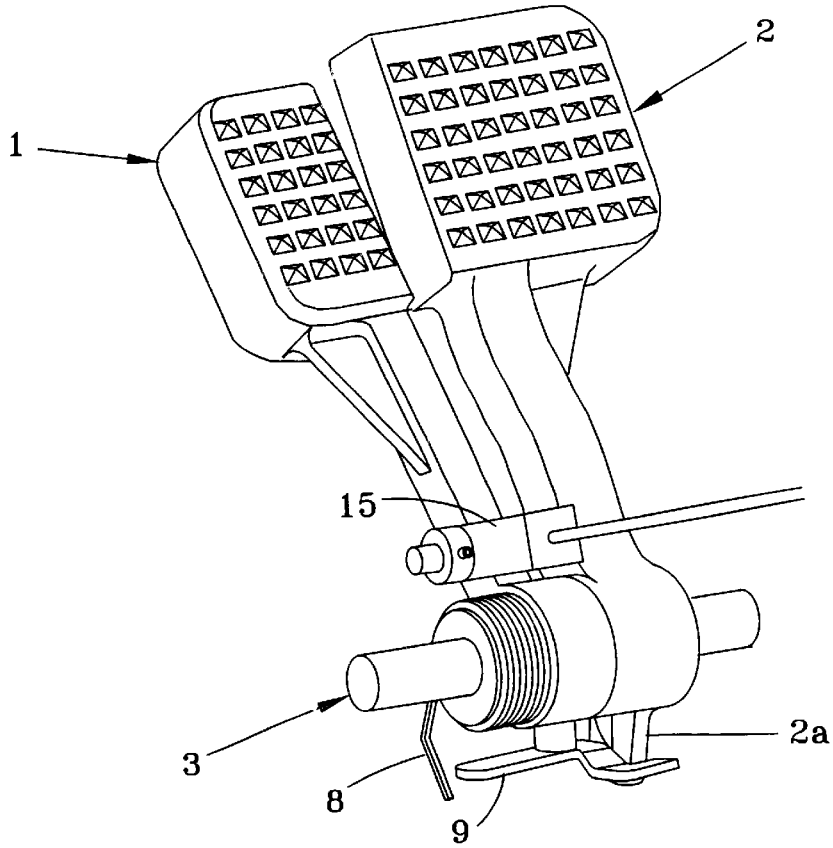
FIGS. 1–7 illustrate one aspect of the invention having a pedal assembly comprising separate parking and service brake pedals.

The inventive pedal assembly comprises a service and parking brake and in some cases an accelerator. In comparison to conventional pedal assemblies, the inventive assembly has a reduced number of parts, expeditious assembly, longer life due to improved corrosion protection, improved mode of operation (especially in the case of emergency brake application), among other desirable aspects.

Any suitable mechanical or electronic accelerator can be employed as a component of the assembly or separately connected to the vehicle. While any suitable electronic accelerator can be employed, examples of suitable accelerators are disclosed in U.S. Pat. Nos. 4,976,166; 5,241,936; 5,697,260 and 5,964,125; the disclosure of each of which is hereby incorporated by reference.

In one aspect of the invention, the service/parking brake pedal are employed by actuating a single lever. When the pedal is depressed by the vehicle operator, in a first stage (or service brake mode) of operation a force is applied to a cable system that in turn engages the brakes, e.g. associated with the rear wheels. Typically, about 30 to about 45 pounds of force are required to engage the service brake. In its second stage of operation, the pedal is depressed further (towards the vehicle floor) or passed its service brake mode and compresses a torsion spring thereby engaging a parking brake. The amount of force to engage the parking brake is relatively large in comparison to operation of the service brake, e.g., about 60 to about 65 pounds. Upon engaging the parking brake, the pedal will lock into a fixed position. The parking brake is released by depressing the accelerator.

The locking mechanism for engaging the parking brake mode of operation comprises a hub about which the brake pedal lever rotates. When the brake pedal is engaged as a parking brake, a one way torsion spring that is mounted about the hub applies a torsional or frictional force about the hub that locks the lever into the parking brake mode. During normal or service brake mode, the torsion spring is disengaged by a trigger assembly, e.g., a spring loaded trigger assembly. When the brake is operated as a parking brake, the trigger assembly is rotated by the pedal lever in such a manner as to allow the torsion spring to hold the hub securely against rotation. Depressing the accelerator pulls a linkage, e.g., rod, cable, etc., that causes the trigger assembly to return or disengage the torsion spring thereby returning the brake to a service mode.

In another aspect of the invention, the brake pedal includes a region defining a pedal button. The pedal button extends upwardly through the surface of the pedal when operating as a parking brake. While the service and parking brake are engaged by movement of the same lever, the parking brake is applied by depressing the pedal without contacting the pedal button. When the pedal is pushed without depressing the pedal button, the "free leg" of the previously described torsion spring will tighten against the hub or drum when the pedal tries to return, therefore causing the pedal to hold in its applied position. To operate as a service brake, the operator simply depresses the pedal button while pushing the pedal. This will disable a torsion spring and allow the pedal to rotate in either direction.

The force generated when applying the brake pedal is transmitted to a braking system. The brake pedal is connected to a braking system in accordance with conventional means. Typically, the pedal is functionally connected to at least one cable that transfers a force from the pedal to the braking system thereby operating the brake. An example of a suitable cable comprises a steel strand that is coated with a suitable corrosion resistant coating such as TPR (coated cables and strand are available from Orscheln Products LLC, Moberly, Mo.). In order to reduce corrosion, fasteners, cable end-fittings, among other metallic components can be coated with yellow chromate, zinc, polymeric materials, among other corrosion resistant coatings.

Certain aspects of the invention are better understood by reference to the drawings. These drawings are provided to illustrate certain aspects of the invention and not limit the scope of the invention as defined by appended claims.

Figure 2:
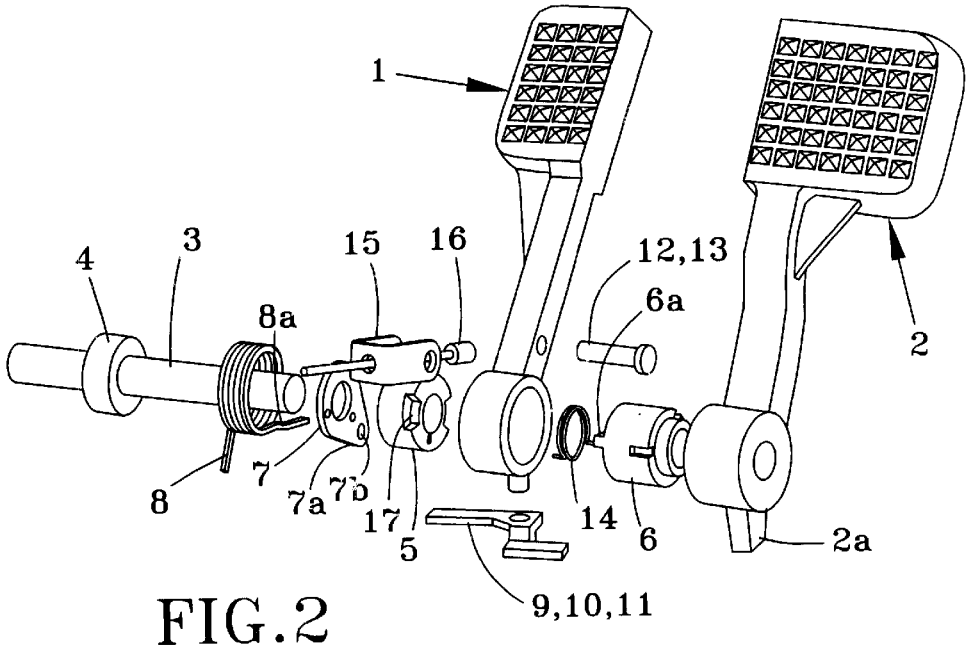
Figure 3:
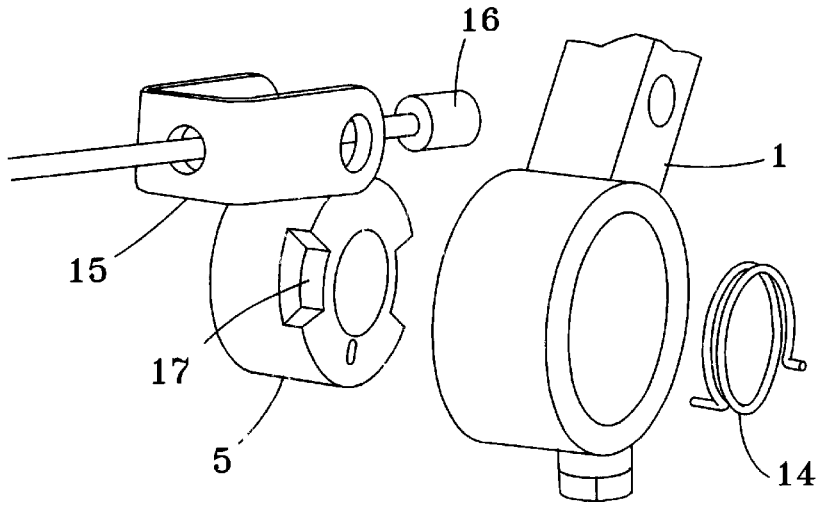
Figure 4:
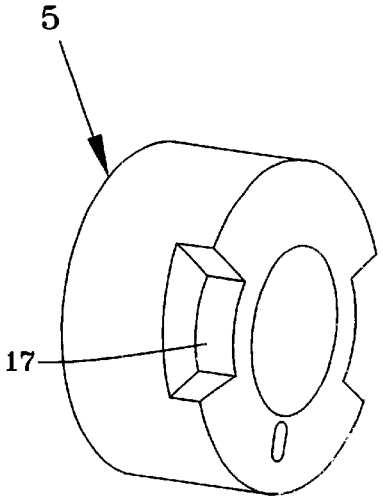
Figure 5:
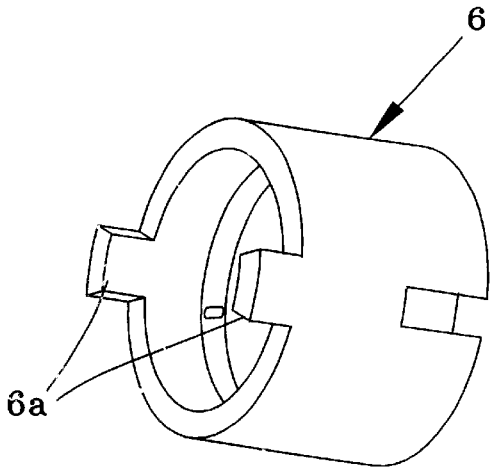
Figure 6:
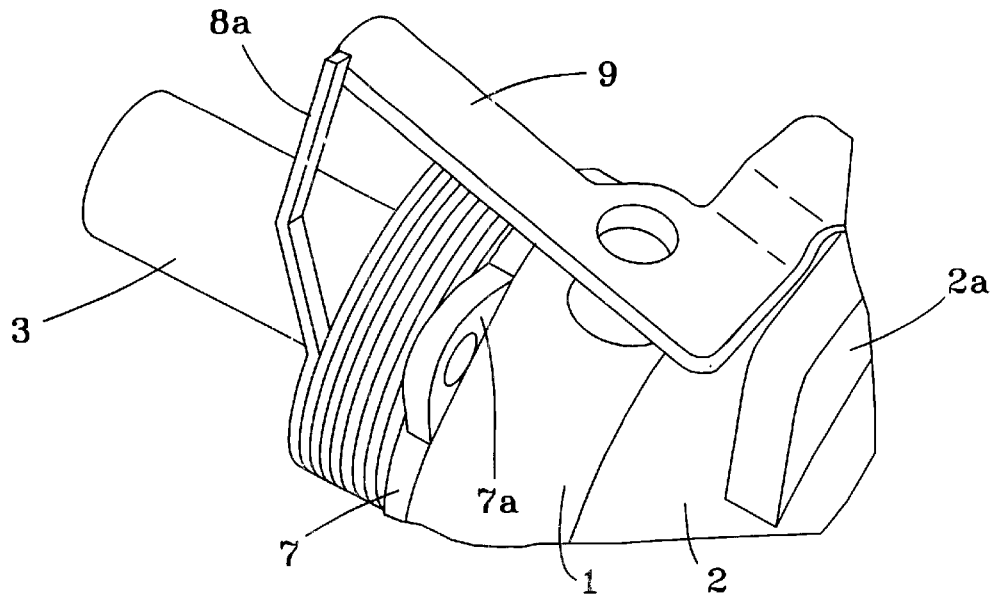

Referring now to FIGS. 1–7, these Figures illustrate a service/parking brake assembly wherein the parking and service brake pedals are mounted on separate levers. The service brake pedal is normally biased in a position relatively close to the vehicle operator. The parking and service brake pedals are, however, mounted on their respective levers in a manner that permits simultaneous depression of both pedals. FIGS. 1 and 2 illustrate parking brake pedal and lever 1, and service brake pedal and lever 2. Parking brake pedal 1 is rotatably mounted upon shaft 3 having hub lock 4. Shaft 3 penetrates parking brake drive hub 5 and service brake drive hub 6. Parking brake pedal lever 1 is mounted upon drive hub 5 that is in turn mounted upon shaft 3. Service brake pedal lever 2 is mounted upon drive hub 6 that is in turn mounted upon shaft 3. Hubs 5 and 6 permit levers 1 and 2 to rotate about shaft 3 together or separately. Parking brake drive hub 5 and hub lock 4 are functionally connected with anchor plate 7. Anchor plate defines a protuberance 7A having an opening 7B into which leg 8A of torsion spring 8 is attached. Torsion spring 8 is mounted about hub lock 4 such that, when compressed, torsion spring 8 locks parking brake pedal lever 1 into a fixed position. Release lever 9 is mounted on the distal end of brake pedal lever 1 (from the pedal pad surface) in a manner such that the release lever 9 can contact leg 8A. Torsion spring 8 is de-compressed or released by activation of release lever 9, pivoting release lever 9 about pin 10 and release lever return spring 11. A downwardly extending tab or protuberance 2A on pedal lever 2 engages release lever 9 thereby causing torsion spring 8 to disengage and permitting parking brake pedal lever 1 to move and release the parking brake.

Pin 12 and clevis 13 mount cable clevis 15 and cable assembly 16 onto parking brake pedal lever 1. Depression (or movement towards the floor) of pedal 1 applies a tension force upon cable assembly 16 thereby engaging the parking brake. By depressing only pedal 1 in order to engage the parking brake, pedal 1 rotates about shaft 3, engages bumper mechanism 17 (at least one and typically two slots or grooves defined) on hub 5 and applies a tension upon torsion spring 8 that maintains pedal 1 in a locked position. Release (return to normal position) of the parking brake pedal disengages bumper mechanism 17 and torsion spring 8. Parking brake pedal 1 can be released by either applying a force upon service brake pedal 2 or the accelerator pedal (not shown in FIGS. 1 and 2). The accelerator pedal can either indirectly or directly contact release lever 9.

When the parking brake pedal lever is released (as previously described) a spring 14 applies a bias that forces parking brake pedal lever into an operational or service brake position. Spring 14 applies a bias to hub 6 that defines at least one and typically two protuberances 6A that engage bumper mechanism 17. That is, spring 14 causes hub 6 to rotate forward (towards the operator) about shaft 3 such that the degree of rotation to defined by the travel of tabs 6A within bumper mechanism 17. When pedal 2 is contacted, hub 6 rotates and tabs 6A move along bumper mechanism 17 until the maximum travel within mechanism 17 is reached after which pedals 1 and 2 can move together. When only pedal 1 is contacted, pedal 1 rotates forward (engages torsion spring 8) causes hub 5 to rotate and engage tabs 6A on hub 6 thereby causing pedal 2 to travel along with and spaced apart from pedal 1. The torsion spring is released by depressing pedal 2 in the manner described above.

Figure 7:
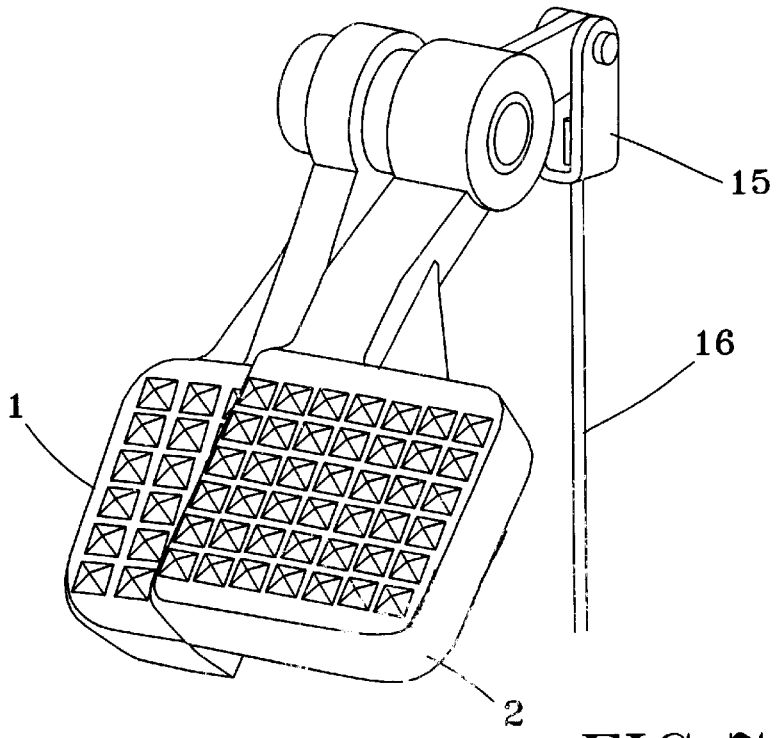
Figure 8:
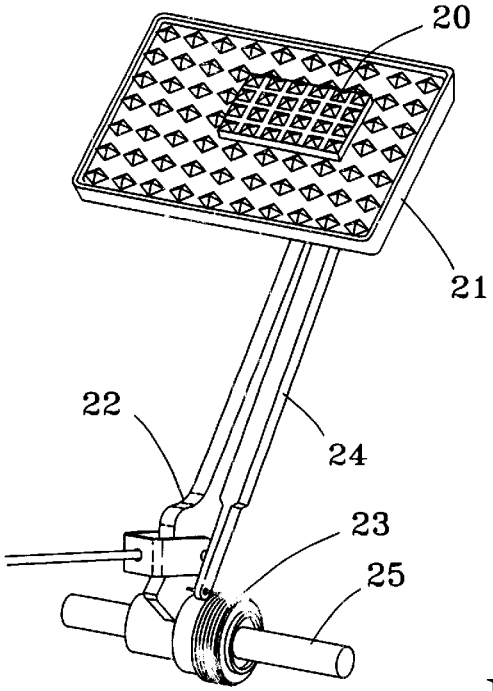
FIGS. 8–11 illustrate another aspect of the invention including a remote button for actuating the parking brake system.
Figure 9:
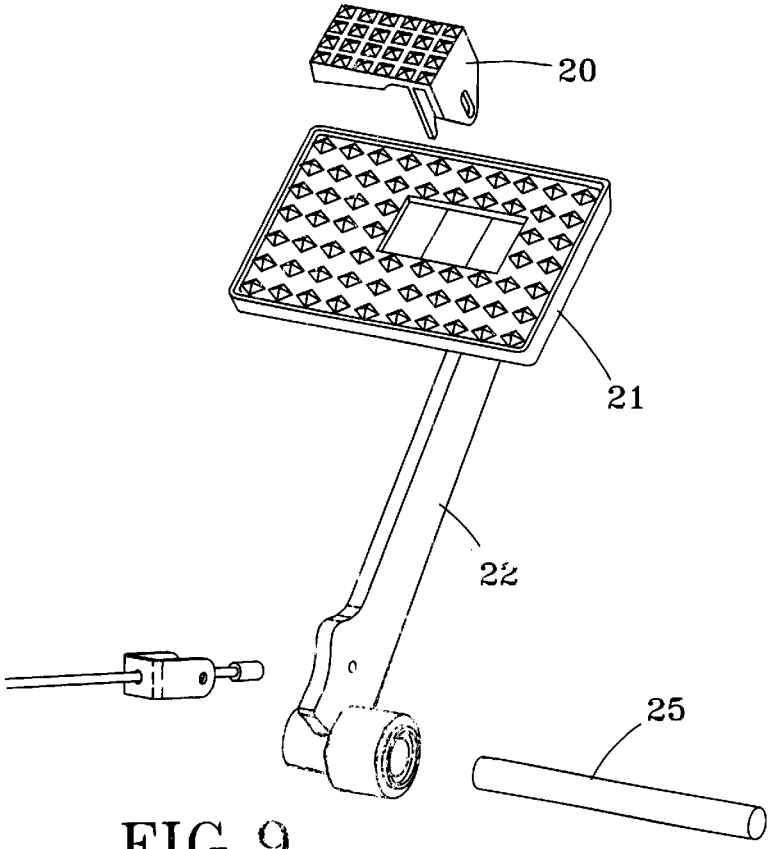

Referring now to FIG. 7, FIG. 7 is another aspect of FIGS. 1–6 with the exception that assembly shown in FIG. 7 is oriented for mounting underneath a dash board. Similar to the above discussion, pedal 2 is biased in a forward position (or toward the operator). Clevis 15 and cable 16 are actuated in response to movement of pedal 1.

Referring now to FIGS. 8–11, these Figures illustrate a second aspect of the invention wherein a torsion lock service/parking brake system has a button for parking brake activation. The button 20 is located upon the surface of the brake pedal pad 21 on brake lever 22 and can easily be depressed when depressing the brake pedal. The second aspect of the invention has the same basic components and function as the first aspect, except the second aspect has a remote button 20 to control application mode. That is, application of a torsion spring 23 for defining service versus park brake operation. To operate as a service brake, the operator simply depresses the pedal button 20 while pushing the pedal 21. This will operate a second lever 24 that contacts leg 23A and disengage torsion lock spring 23 that is mounted around a shaft 25 (about which the pedal lever 22 rotates), and allow the pedal to rotate in either direction thereby permitting the vehicle operator to modulate operation of the service brake. To operate as a park brake, the operator depress the pedal pad 21 outside of (or without contacting) the button area 20. The button 20 will pop-up or protrudes upwardly beyond the surface of the pedal pad 21 thereby providing a visual indication that the brake is operating as a parking brake. When the pedal lever 22 is pushed without depressing the pedal button 20, the "free leg" 23B of the torsion spring 23 will tighten against the drum when the pedal lever 22 tries to return, therefore causing the pedal lever 22 to hold in its applied position.

Figure 10:
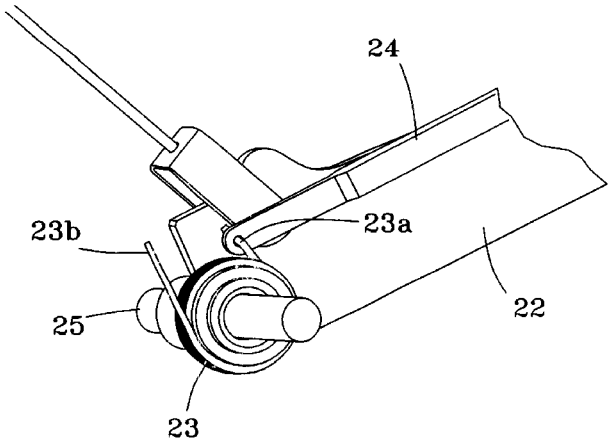

Referring now to FIG. 10, FIG. 10 shows the second lever 24 contacting leg 23A of the torsion spring 23. When the parking brake button 20 is depressed along with the brake pedal pad 21, the second lever 24 disengages the torsion spring 23 from shaft 25 thereby permitting the pedal or brake lever 22 to rotate about shaft 25. That is, when the button 20 is depressed, leg 23A of torsion spring 23 is pulled thus causing the torsion spring 23 to disengage from shaft 25 thereby allowing rotation of lever 22 in either direction. When the parking brake button 20 is not depressed along with the brake pedal pad 21, the second lever 24 engages the torsion spring 23 thereby biasing the spring and generating a frictional force and eventually preventing rotation of the brake lever about the drum.

Figure 11:
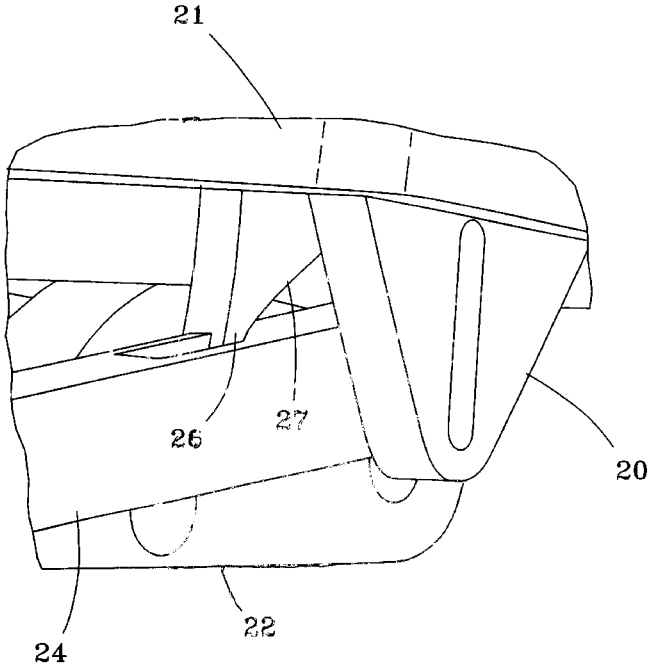

Referring now to FIG. 11, FIG. 11 illustrates a cam pin 26 located on a distal end of the second lever that contacts a cam surface 27 on an underneath portion of the parking brake button 20. When the button 20 is not depressed, a camming action between button 20 and lever 24 causes button 20 to extend upwardly or beyond the surface of pedal pad 21.

The components of the inventive pedal assembly can be fabricated from conventional materials in accordance with processes known in this art. For example, stamped steel, sintered metal, die cast zinc or aluminum, mineral filled nylon, among other conventional materials can be employed for fabricating pedal components.

The following is claimed:

1. An assembly comprising:

a parking brake pedal lever mounted upon a hub that defines an opening for receiving a shaft wherein said hub and lever are rotatably mounted on said shaft, a service brake pedal lever rotatably mounted on said shaft, an accelerator pedal lever and;

a torsion spring mounted around said shaft wherein said torsion spring engages said shaft when the parking brake pedal is singularly operated and said torsion spring is disengaged by operating either said service brake pedal lever or said accelerator pedal lever.

2. An assembly comprising:

a service brake pedal lever, an accelerator pedal lever, a parking brake pedal lever that defines an opening for receiving a shaft wherein said lever is rotatably mounted on said shaft, a torsion spring mounted around said shaft that engages the shaft in response to movement of said parking brake pedal lever, and;

a release lever that disengages said torsion spring upon operation of the service brake pedal lever or said accelerator pedal lever.

3. A pedal assembly comprising:

a parking brake pedal lever mounted upon a first hub that defines an opening for receiving a shaft wherein said first hub and the parking brake lever are rotatably mounted on said shaft, a service brake pedal lever mounted upon a second hub that defines an opening for receiving said shaft wherein said second hub and the service brake lever are rotatably mounted on said shaft, a torsion spring mounted around said shaft that engages in response to movement of said parking brake pedal lever, and;

a release lever mounted on said service brake pedal lever that disengages said torsion spring.

4. An assembly comprising:

a service brake pedal lever, an accelerator pedal lever, a parking brake pedal lever mounted upon a hub that defines an opening for receiving a shaft wherein said hub and said service brake pedal lever are rotatably mounted on said shaft, a torsion spring mounted around said shaft that engages the shaft in response to movement of said parking brake pedal lever, a means for disengaging said torsion spring, and;

a brake cable that actuates braking system in response to movement of said parking brake pedal lever.

5. The pedal assembly of claim 3 wherein the service brake pedal lever is biased into a position relative to the parking brake lever.

6. The pedal assembly of claim 3 wherein the service and parking brake levers define pedal pad areas and wherein the pedal pad area of the service brake is larger than the parking brake pad area.

7. The assembly of claim 1 wherein said accelerator pedal lever is associated with an electronic accelerator.

8. The assembly of claim 1 wherein said pedal assembly is mounted to the floor of a vehicle.

9. The assembly of claim 1 wherein said pedal assembly is mounted to a vehicle dash board.

10. The assembly of claim 1 wherein said service and parking brake levers define pedal pad areas.

11. The assembly of claim 1 wherein said parking brake lever is associated with a means for disengaging the parking brake lever.

12. The assembly of claim 11 wherein a service brake lever comprises at least one protuberance for contacting said release lever.

13. The assembly of claim 1 wherein a first end of the torsion spring contacts the parking brake pedal lever and a second end of the torsion spring is positioned to contact a release lever.

14. The assembly of claim 11 wherein when the torsion spring is engaged the parking brake pedal lever is maintained in a fixed position.

15. The assembly of claim 1 wherein parking brake pedal lever is located about a first hub and the service brake pedal is located about a second hub, and the first and second hubs can rotate separately or together about the shaft.

16. The assembly of claim 1 wherein the parking brake lever is located about a first hub, the service brake pedal lever is located about a second hub, and the torsion spring is located about a third hub.

17. The assembly of claim 1 wherein the parking brake pedal lever and the service brake parking lever can rotate separately or together about the shaft and wherein singular rotation of the parking brake pedal lever causes the torsion spring to engage thereby maintaining the parking brake pedal lever in a fixed location.

18. The assembly of claim 15 wherein the first hub defines tabs that engage slots defined on the second hub.

19. The assembly of claim 11 wherein the means for disengaging comprises a lever.

20. An assembly comprising:

a parking brake pedal lever that defines an opening for receiving a shaft wherein said parking brake pedal lever is rotatably mounted on said shaft, a service brake pedal lever rotatably mounted on said shaft, an optional accelerator pedal lever and;

a torsion spring mounted around said shaft comprising a first end that contacts the parking brake pedal lever and a second end that is positioned to contact a means for disengaging said torsion spring and wherein said torsion spring engages the shaft when the parking brake pedal is singularly operated and said means for disengaging functions by operating either said service brake pedal lever or said accelerator pedal lever.

21. An assembly comprising:

a parking brake pedal lever that defines an opening for receiving a shaft wherein said parking brake pedal lever is rotatably mounted on said shaft, a service brake pedal rotatably mounted on said shaft wherein the service brake pedal lever is biased into a position relative to the parking brake lever, an optional accelerator pedal lever;

a torsion spring mounted around said shaft, and;

a means for disengaging said torsion spring wherein movement of the service brake into an unbiased position or with the parking brake pedal lever causes operation of means for disengaging the torsion spring thereby preventing the torsion spring from engaging the shaft and permitting the parking brake pedal lever to rotate about the shaft with the service brake pedal lever, and wherein singular movement of parking brake pedal lever causes said torsion spring to engage the shaft thereby maintaining the parking brake pedal lever in a fixed location and the parking brake pedal lever is released from the fixed position by the means for disengaging which operates in response to movement of the service brake pedal lever or said optional accelerator pedal lever.

* * * * *